US010077788B2

(12) United States Patent
Xiong et al.

(10) Patent No.: US 10,077,788 B2
(45) Date of Patent: Sep. 18, 2018

(54) REGENERATIVE RESERVOIR

(71) Applicants: Shaoping Xiong, Hartford, WI (US); Robert Quandt, Hartford, WI (US)

(72) Inventors: Shaoping Xiong, Hartford, WI (US); Robert Quandt, Hartford, WI (US)

(73) Assignee: Helgesen Industries, Inc., Hartford, WI (US)

( * ) Notice: Subject to any disclaimer, the term of this patent is extended or adjusted under 35 U.S.C. 154(b) by 0 days.

(21) Appl. No.: 15/068,190

(22) Filed: Mar. 11, 2016

(65) Prior Publication Data

US 2016/0273555 A1 Sep. 22, 2016

Related U.S. Application Data

(60) Provisional application No. 62/135,558, filed on Mar. 19, 2015.

(51) Int. Cl.

| | |
|---|---|
| ***F17D 1/00*** | (2006.01) |
| ***F15B 1/26*** | (2006.01) |
| ***F15B 1/027*** | (2006.01) |
| ***F15B 1/04*** | (2006.01) |
| *F15B 21/04* | (2006.01) |

(52) U.S. Cl.

CPC ..... *F15B 1/26* (2013.01); *F15B 1/027* (2013.01); *F15B 1/04* (2013.01); *F15B 1/265* (2013.01); *F15B 21/047* (2013.01); *F15B 2201/411* (2013.01); *F15B 2211/20584* (2013.01); *F15B 2211/30505* (2013.01)

(58) Field of Classification Search

CPC ..... F15B 1/26; F15B 1/265

See application file for complete search history.

(56) References Cited

U.S. PATENT DOCUMENTS

| | | | |
|---|---|---|---|
| 2,392,720 | A | 1/1946 | Beach |
| 2,764,999 | A | 10/1956 | Stanbury |
| 3,015,345 | A | 1/1962 | Michael |
| 3,846,983 | A | 11/1974 | Freedy et al. |
| 3,889,705 | A | 6/1975 | Coderre |

(Continued)

FOREIGN PATENT DOCUMENTS

| | | | |
|---|---|---|---|
| CN | 101925750 | A | 12/2010 |
| EP | 0253917 | A1 | 1/1988 |
| FR | 2148613 | A1 | 3/1973 |

OTHER PUBLICATIONS

Variable Volume Reservoir; date last visited Jun. 8, 2016; 1 page; http://www.variablevolumereservoir.com/.

(Continued)

*Primary Examiner* — Craig Schneider
*Assistant Examiner* — Angelisa L Hicks
(74) *Attorney, Agent, or Firm* — Reinhart Boerner Van Deuren P.C.

(57) ABSTRACT

A fluid storage reservoir that creates a regenerative loop inside the reservoir to maintain a pressurized main suction chamber of the hydraulic fluid reservoir is provided. This reservoir includes two separate chambers which are operably fluidly connected by one or more check valves. In the main suction chamber, the design arranges the return flow larger than suction flow in order to pressurize this chamber. This pressure can be adjusted by the check valve setting. This regenerative reservoir can provide sufficient pressure when large system flow occurs.

15 Claims, 4 Drawing Sheets

(56) References Cited

U.S. PATENT DOCUMENTS

| | | | | |
|---|---|---|---|---|
| 4,827,719 | A * | 5/1989 | Paoluccio | F15B 1/265 60/478 |
| 2009/0191068 | A1 | 7/2009 | St. Aubin | |
| 2015/0226241 | A1 * | 8/2015 | Tanaka | F15B 1/26 96/215 |

OTHER PUBLICATIONS

Reservoir, Hydraulic—Description; date last visited Jun. 8, 2016; 8 pages; http://www.daerospace.com/HydraulicSystems/ReservoirDesc.php.

Aeronautics—Aircraft Hydraulics—Level 3 (Pressurized Reservoirs) date last visited Jun. 8, 2016; 3 pages; http://www.allstar.fiu.edu/aero/Hydr07.htm.

Hydraulic Reservoirs; date last visited Jun. 8, 2016; 1 page http://www.eaton.com/Eaton/ProductsServices/Aerospace/Hydraulics/PCT_249177.

* cited by examiner

REGENERATIVE RESERVOIR

CROSS-REFERENCE TO RELATED PATENT APPLICATIONS

This patent application claims the benefit of U.S. Provisional Patent Application No. 62/135,558, filed Mar. 19, 2015, the entire teachings and disclosure of which are incorporated herein by reference thereto.

FIELD OF THE INVENTION

This invention generally relates to fluid reservoirs and particularly the hydraulic fluid reservoirs configured to pressurize the fluid at the suction side of the reservoir.

BACKGROUND OF THE INVENTION

Many off-road vehicles or heavy machines such as tractors, excavators, trucks, utilize a hydraulic system to accomplish power transmission for traveling or other heavy duty operations, e.g. operation of hydraulic rams and transmissions. Hydraulic fluid is significant to the performance of the hydraulic system as it is a power transmission medium, a lubricant of the hydraulic system, a heat-transfer medium and even a sealant in some situations.

Being the storage mechanism for the hydraulic fluid, it is desirable for the hydraulic fluid reservoir to provide the hydraulic system and, particularly, the hydraulic pump with hydraulic fluid of good quality that is free of particles and entrained air. Entrained air and particles will affect the performance and operability of various components of the hydraulic system such as the hydraulic pump. Due to operating conditions, the hydraulic fluid reservoir is often required to be capable of removing the particles and entrained air from the return flow.

A return filter and diffusing baffle have been adopted in hydraulic fluid reservoir design to remove particles and entrained air in the hydraulic fluid. However, when a considerably large flow is pumped through the suction port of the hydraulic fluid reservoir, the suction pressure may significantly reduce. This reduction in suction pressure can cause two types of cavitation. First, the gaseous type of cavitation is based on the release of the air dissolved in the fluid. Second, the liquid vaporization type of cavitation is based on the vaporization of the hydraulic fluid. This cavitation may cause a severe loss of pump efficiency and further reduce its service life due to cavitation wear. Therefore, a pressurized hydraulic fluid reservoir may be needed in order to deal with above situations and prevent undesirable pressure drops at the suction port and thus the inlet of a pump.

A prevailing technology for pressurizing fluid in the reservoir is to pressurize the air inside the reservoir. This pressure can be set following the ideal gas law. However, this technology demands the hydraulic fluid reservoir have more space to accommodate and manipulate the air pressure. Also, this technology exposes the fluid to more pressurized air, which will cause the hydraulic fluid in the reservoir to entrain more air and other impurities. Additionally, the air pressure will fluctuate when the hydraulic fluid inside the reservoir is at a drawn down level, such as, for example, upon displacement of a hydraulic cylinder.

The present invention provides improvements in hydraulic fluid storage reservoirs to provide a sufficient suction pressure at a high flow rate without increasing the storage volume and amount of entrained air in the fluid.

BRIEF SUMMARY OF THE INVENTION

Embodiments of the present invention relate to a new and improved hydraulic fluid storage reservoir. More particularly, embodiments of the present invention relate to a new and improved fluid storage reservoir that creates a regenerative loop inside the reservoir to maintain a pressurized suction chamber of the hydraulic fluid reservoir by arranging the position of reservoir ports and utilizing a pair of check valves. The proposed design concept saves the space of pressurized air and avoids the exposure of fluid at the main suction to the air.

In one embodiment, a hydraulic reservoir comprising first and second chambers is provided. The second chamber is separated from the first chamber. A first flow path operably fluidly connects the first chamber with the second chamber. A first check valve allows fluid flow from the first chamber to the second chamber upon a first differential pressure between the first and second chambers.

In one embodiment, a second flow path operably fluidly connects the first chamber with the second chamber and includes a second check valve allowing fluid flow from the second chamber to the first chamber upon a second differential pressure between the first and second chambers.

In one embodiment, a volume of the second chamber is larger than a volume of the first chamber.

In one embodiment, the volume of the second chamber is at least twice as large as the volume of the first chamber and more preferably at least 5 times larger.

In one embodiment, the first chamber is maintained at a higher pressure than the second chamber.

In one embodiment, the first chamber is maintained at a different pressure than the second chamber.

In one embodiment, the first differential pressure is greater than the second differential pressure.

In one embodiment, the first chamber has a return port where return fluid enters the first chamber and a first suction port where fluid exits the first chamber and the second chamber has a second suction port where fluid exits the second chamber.

In one embodiment, fluid flow through the return port is equal to or greater than fluid flow through the first suction port.

In one embodiment, fluid within the second chamber is pressurized by a volume of gaseous fluid stored within the second chamber and fluid within the first chamber is solely pressurized by return fluid flowing into the return port and fluid flowing from the second chamber into the first chamber through the second flow path.

In one embodiment, no gaseous fluid is stored in the first chamber.

In another embodiment, a hydraulic system including a fluid reservoir from above is provided. The system further includes a main pump, a secondary pump and a return port is provided. The main pump fluidly connects to the first chamber. The secondary pump fluidly connects to the second chamber. The return port fluidly connects to the first chamber. The return port receives fluid from both the main pump and the secondary pump.

In one embodiment, the main pump has a higher flow rate than the secondary pump.

In one embodiment, flow into the first chamber through the return port is greater than flow out of the first chamber via the main pump.

In an embodiment, a method of supply fluid using a hydraulic system from above is provided. The method includes removing fluid from the first chamber at a first rate using the main pump and returning fluid to the first chamber at a second rate. The second rate is greater than the first rate.

In one embodiment, the method includes removing fluid from the second chamber with the secondary pump and returning fluid from the second pump to the first chamber.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
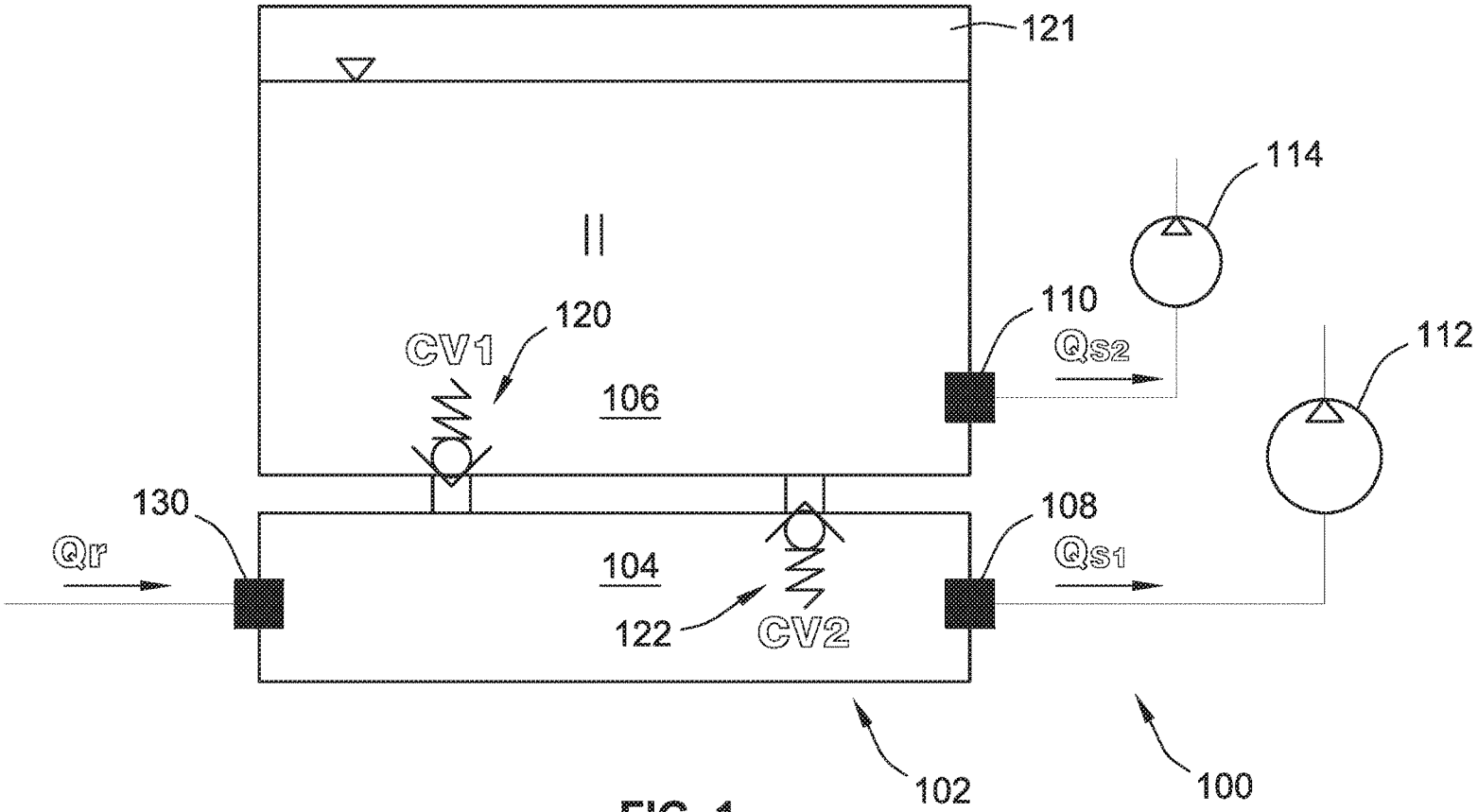
FIG. 1 is a simplified cross-sectional illustration of a fluid storage reservoir and system according to an embodiment of the invention.

FIG. 1 is a simplified illustration of an embodiment of a hydraulic system 100 having a hydraulic fluid reservoir 102 according to the teachings of an embodiment of the present invention.

Hydraulic systems of many machines and particular heavy duty machines may include several hydraulic pumps with different purposes. A main pump may be used, for example, to power travel. The main pump will usually have the highest flow rate (>100 gpm for example). An auxiliary pump may be used to fulfill duty cycle events such as swing or boom. An auxiliary pump will usually have a medium flow rate (30-60 gpm for example). A pilot pump will usually have a small flow rate (4-20 gpm for example).

Figure 2:
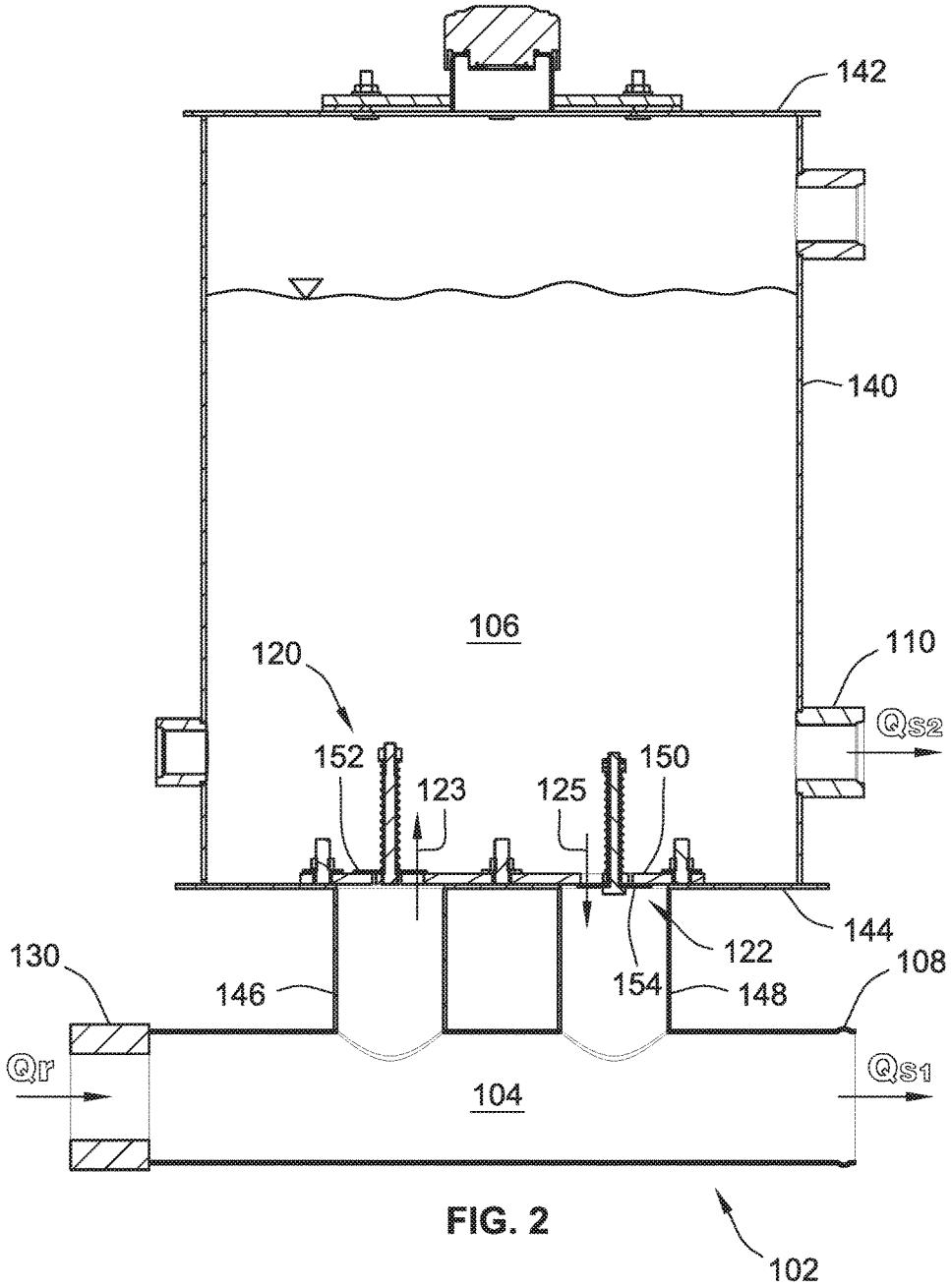
FIGS. 2-4 are cross-sectional illustrations of a detailed version of a fluid storage reservoir for use in the system of FIG. 1.
Figure 3:
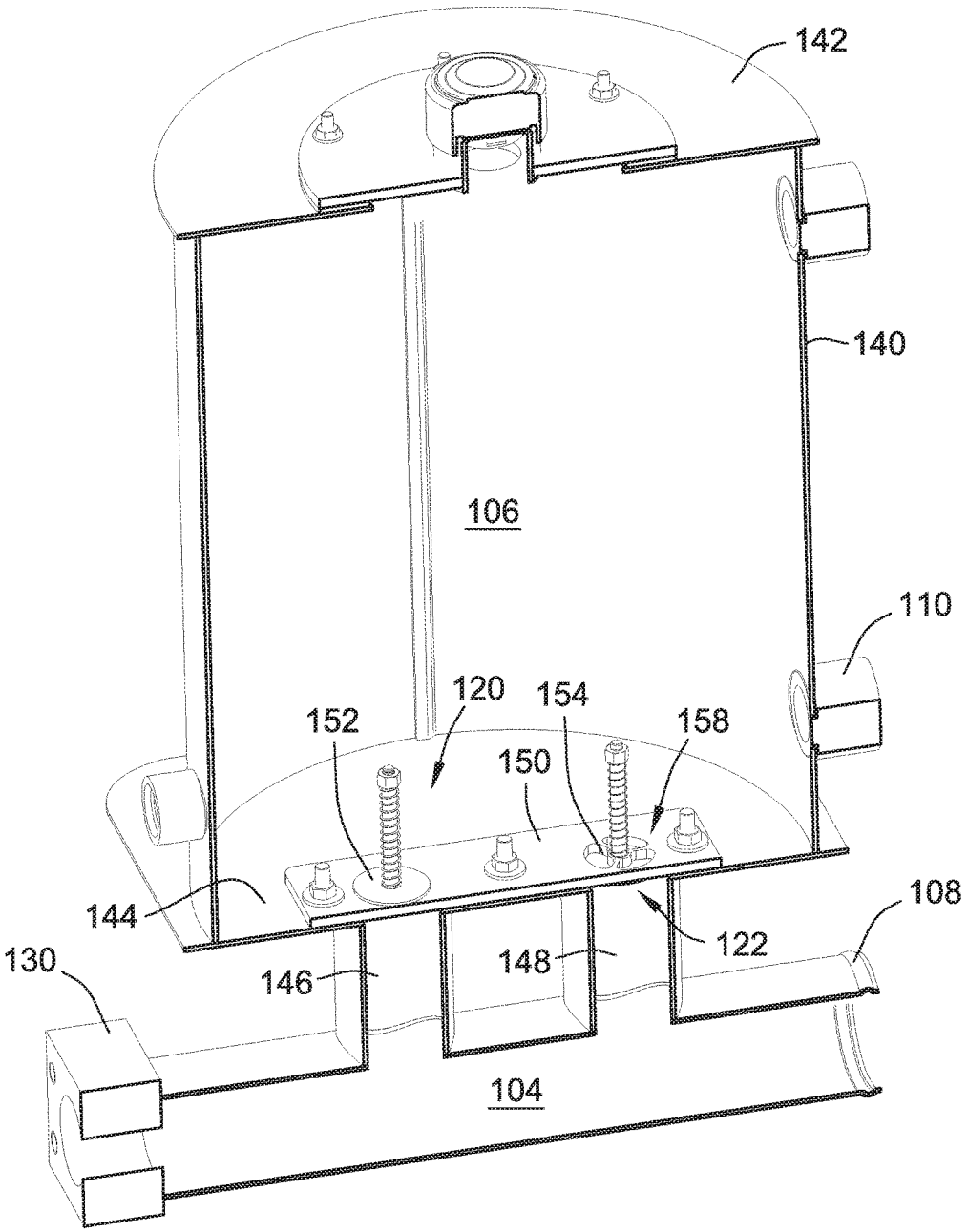
Figure 4:
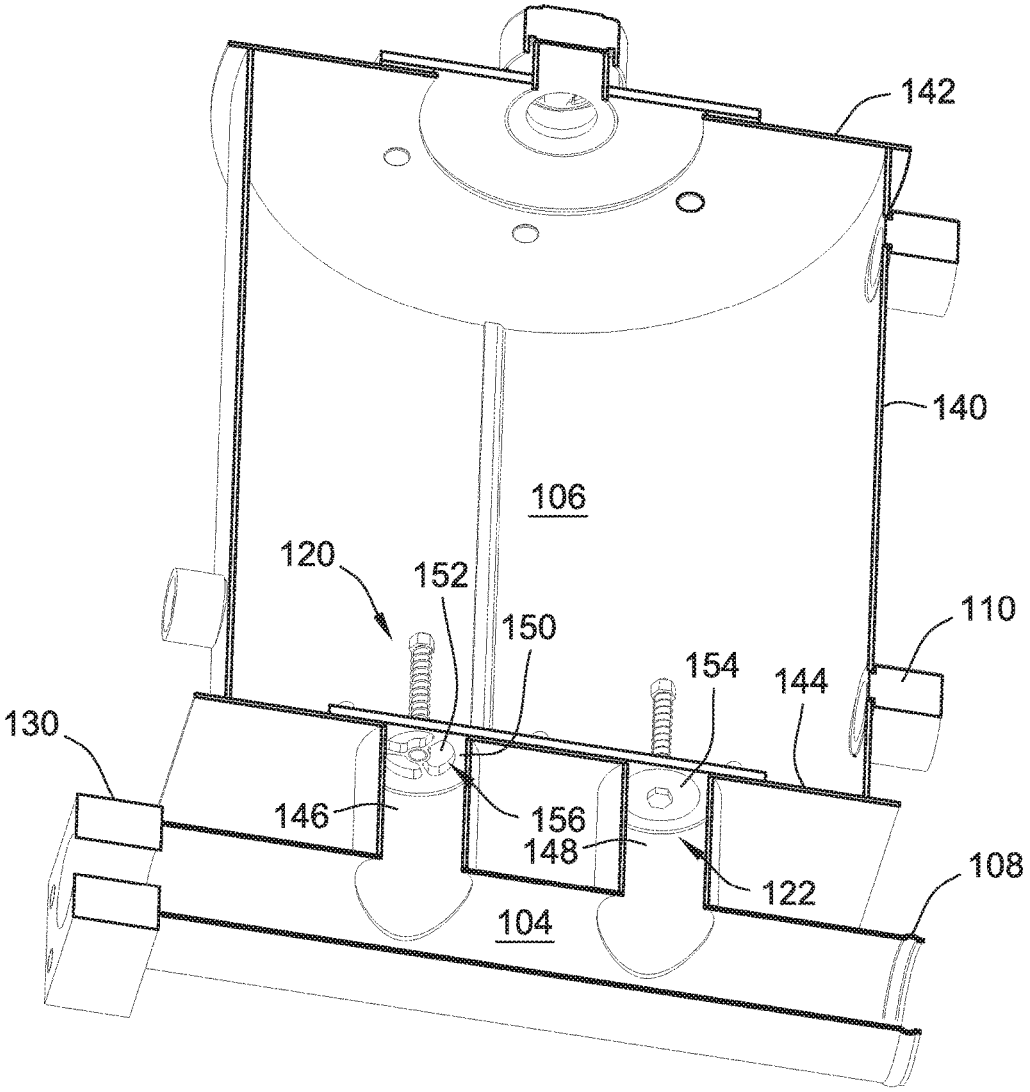

With principle reference to FIG. 1 and supplemental reference to FIGS. 2-4, the hydraulic fluid reservoir 102 is divided into two chambers 104 and 106, each of which includes a suction port 108, 110 for a specific pump 112, 114 (FIG. 1). The two chambers 104, 106 are separated and two check valves 120, 122 are used to commute flow therebetween. The check valves 120, 122 permit the flow in opposite directions between chambers 104, 106, illustrated by arrows 123, 125 in FIG. 2 and prevent flow through check valves 120, 122 opposite arrows 123, 125.

The suction port 108 of chamber 104 is connected to the main pump 112 with a large flow rate $Q_{s1}$ (also referred to as "main suction flow") and the suction port 110 of chamber 106 is connected to a secondary pump 114 with a smaller flow rate $Q_{s2}$. For instance, the secondary pump 114 could be either an auxiliary pump or a pilot pump discussed above. While particular flow rates are identified above, the system described herein could operate with different flow rates.

The return flow $Q_r$ from both circuits (assume in this example case drain flow is included) goes to the return port 130 in fluid communication with chamber 104. Normally, the return flow $Q_r$ should be equivalent to the sum of large flow rate $Q_{s1}$ and small flow rate $Q_{s2}$, so naturally larger than large flow rate $Q_{s1}$. As such, there would be a disproportional flow into chamber 104 as compared to what is leaving chamber 104 via suction port 108.

The pressure inside the chamber 104 will increase until it reaches the cracking pressure $p_1$ of check valve 120 (also referred to as "CV1"). This allows chamber 104, which provides the large flow rate $Q_{s1}$ to be pressurized at $p_1$, for example 5 psi, to avoid cavitations. For chamber 106, the atmospheric pressure, illustrated by an upside down triangle, is sufficient to pressurize the small flow rate $Q_{s2}$ within chamber 106. In this situation, the return flow from the secondary pump 114 or chamber 106 is directed into chamber 104 to regenerate the pressure for the main suction line, which provides large flow rate $Q_{s1}$. By only requiring atmospheric pressure, chamber 106 can be allowed to breath.

In some embodiments the pressure within chamber 106 may be maintained using a gaseous volume of fluid 121. Typically this gaseous volume of fluid 121 will be air. However, other gaseous fluids could be used. This will operate similar to prior reservoirs.

When a system displaces a volume of the hydraulic fluid, which is not immediately returned to the fluid reservoir 102, such as during cylinder displacement for a hydraulic cylinder, the main circuit may have a differential flow rate, which may lead to a return flow $Q_r$ that is less than main suction flow $Q_{s1}$. In this case, the pressure in chamber 104 will drop until the check valve 122 (also referred to as "CV2") is cracked open and then the fluid in chamber 106 will flow through check valve 122 (see e.g. arrow 125 in FIG. 2) to prevent the pressure loss in chamber 104. The pressure setting $p_2$ for check valve 122 should be small relative to $p_1$, for example, 1 psi to avoid delayed opening of check valve 122. In this instance, fluid from chamber 106 is used to maintain pressure for the fluid in chamber 104 from which the main flow is drawn, rather than air as in prior systems.

According to above description, it can be found that this regenerative reservoir 102 can normally maintain a pressurized main suction port 108 for a large system flow rate without exposing the fluid in chamber 104 to the air, such as in the air pressurized systems. This reservoir design has no requirements on the volume size of chamber 104, it can be very small such as 1 gallon. The only volume requirement of the regenerative reservoir will be on the chamber 106 to handle the total differential volume of the downstream system, e.g. the cylinder displacement volume and potentially any compensation for tilting of the fluid reservoir.

By using this system, the pressurized chamber, i.e. chamber 104, provides sufficient positive head pressure to the main suction port 108 operably coupled to main pump 112 that provides for large flow rate going therethrough.

Not only can this type of system compensate for a change in volume of the fluid within the hydraulic fluid reservoir 102 due to downstream system components, this type of system can compensate for thermal expansion of the fluid within the reservoir 102 or the entire system 100.

Filtration may be provided for check valves 120, 122. Additionally, filtration may be provided upstream of return port 130.

The low pressure chamber could be made of metal or plastic.

Again, because the system utilizes the hydraulic fluid itself to maintain pressure rather than air pressure within the tank, they hydraulic fluid stored within the reservoir will be less likely to entrain air.

While the present system includes a check valve to allow flow from the second chamber 106 to the first chamber 104, it is contemplated that this second check valve 122 need not be incorporated in all embodiments, particularly where $Q_{s1}$ will not drop sufficiently below $Q_r$ or for a sufficiently long time such that the pressure within chamber 104 drops sufficiently low to prevent a desired pressure head to supply fluid to the main pump 112.

FIGS. 2-4 illustrate the fluid reservoir 102 in more detail. In this embodiment, second chamber 106 has a cylindrical sidewall 140 a top 142 and a bottom 144. Two flow passages 146, 148 couple the first chamber 104 to the second chamber 106 through bottom 144.

A plate 150 forms part of bottom 144 and carries and operably sealing cooperates with first and second spring biased valve members 152, 154. Springs bias valve members 152, 154 in opposite directions against plate 150 to operably engage plate 150 and close flow ports 156 (see FIG. 4), 158 (see FIG. 3) to provide check valves 120, 122. Plate 150 could be eliminated in other embodiments. Valve member 152 will disengage plate 150 and permit fluid flow (illustrated by arrow 123 in FIG. 2) when the pressure in chamber 104 is sufficiently larger than the pressure in chamber 106 to overcome the spring force being applied to valve member 152. Valve member 154 will disengage plate 150 and permit fluid flow (illustrated by arrow 125 in FIG. 2) when the pressure in chamber 104 is sufficiently smaller than the pressure in chamber 106 to overcome the spring force being applied to valve member 154.

A further significant benefit provided by the fluid reservoir 102 of the instant application is that the first and second reservoirs 104, 106 can be located remote from one another and the chambers can thus be locate at more desirable locations within the machine. In prior systems, the reservoir was required to be so large that undesirable placement of the reservoir often occurred.

Another significant benefit of this system is that due to the positive pressure supplying fluid to the pumps, there is no need to have the pumps and particularly the main pump located below the suction ports of the reservoir. This also facilitates locating the reservoir in more desirable locations on the piece of equipment.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A hydraulic reservoir comprising:

a first chamber;

a second chamber separated from the first chamber;

a first flow path operably fluidly connecting the first chamber with the second chamber including a first check valve allowing fluid flow from the first chamber to the second chamber upon a first differential pressure between the first and second chambers;

a second flow path operably fluidly connecting the first chamber with the second chamber including a second check valve allowing fluid flow from the second chamber to the first chamber upon a second differential pressure between the first and second chambers;

the first chamber has a return port where return fluid enters the first chamber and a first suction port where fluid exits the first chamber and the second chamber has a second suction port where fluid exits the second chamber; and wherein fluid passing between the first and second chambers through the first and second flow paths passes between the first and second chambers without passing through any of the return port, first suction port or second suction port.

2. The hydraulic reservoir of claim 1, wherein a volume of the second chamber is larger than a volume of the first chamber.

3. The hydraulic reservoir of claim 2, wherein the volume of the second chamber is at least twice as large as the volume of the first chamber and more preferably at least 5 times larger.

4. The hydraulic reservoir of claim 1, wherein the first chamber is maintained at a higher pressure than the second chamber.

5. The hydraulic reservoir of claim 1, wherein the first chamber is maintained at a different pressure than the second chamber.

6. The hydraulic reservoir of claim 1, wherein the first differential pressure is greater than the second differential pressure.

7. The hydraulic reservoir of claim 1, where fluid flow through the return port is equal to or greater than fluid flow through the first suction port.

8. The hydraulic reservoir of claim 1, further comprising wherein fluid within the second chamber is pressurized by a volume of gaseous fluid stored within the second chamber and fluid within the first chamber is solely pressurized by return fluid flowing into the return port and fluid flowing from the second chamber into the first chamber through the second flow path.

9. The hydraulic reservoir of claim 8, wherein no gaseous fluid is stored in the first chamber.

10. A hydraulic system including a hydraulic reservoir according to claim 1, the system further comprising:

a main pump fluidly connected to the first suction port of the first chamber;

a secondary pump fluidly connected to the second suction port of the second chamber;

wherein the return port receives fluid from both the main pump and the secondary pump.

11. The hydraulic system of claim 10, wherein the main pump has a higher flow rate than the secondary pump.

12. The hydraulic system of claim 10, wherein flow into the first chamber through the return port is greater than flow out of the first chamber via the main pump.

13. A method of supply fluid using the system of claim 10 comprising:

removing fluid from the first chamber at a first rate using the main pump and returning fluid to the first chamber at a second rate, the second rate being greater than the first rate.

14. The method of claim 13, further comprising removing fluid from the second chamber with the secondary pump and returning fluid from the secondary pump to the first chamber.

15. The hydraulic system of claim 10, wherein fluid flow from the first suction port to the return port does not pass through either of the first or second check valves and wherein fluid flow from the second suction port to the return port does not flow through either of the first or second check valves.

* * * * *